US006190740B1

(12) United States Patent
Rogers

(10) Patent No.: US 6,190,740 B1
(45) Date of Patent: Feb. 20, 2001

(54) ARTICLE PROVIDING CORROSION PROTECTION WITH WEAR RESISTANT PROPERTIES

(76) Inventor: Frank S Rogers, 4955 NW. Uff Da La., Silverdale, WA (US) 98383

( * ) Notice: Under 35 U.S.C. 154(b), the term of this patent shall be extended for 0 days.

(21) Appl. No.: 09/444,940

(22) Filed: Nov. 22, 1999

(51) Int. Cl.[7] ..... B05D 1/03

(52) U.S. Cl. ..... 427/446; 427/449; 427/450; 427/453; 427/456

(58) Field of Search ..... 427/192, 205, 427/446, 450, 453, 456, 449

(56) References Cited

U.S. PATENT DOCUMENTS

| | | | | |
|---|---|---|---|---|
| 4,148,971 | * | 4/1979 | Kawano et al. | 428/558 |
| 4,961,973 | * | 10/1990 | Molnar | 427/423 |
| 4,987,003 | * | 1/1991 | Schuster et al. | 427/37 |
| 4,992,337 | * | 2/1991 | Kaiser et al. | 4286/642 |
| 5,133,126 | * | 7/1992 | Matsuoka | 29/527.4 |

OTHER PUBLICATIONS

Alcotech Inc. Traverse City, MI 49684 Manufacturer of solid wire Aluminum/Oxide (90/10) Referenced line 24 p. 2, No date.

The Platt Bros. & Co. Waterbury, CT. 06721 Manufacturer of solid wire Zinc/Aluminum (85/15) Referenced line 6 p. 3, No date.

* cited by examiner

*Primary Examiner*—Brian K. Talbot

(57) ABSTRACT

A process for creating a coating that protects the underlying article from corrosion and provides a surface that prolongs service life against wear, such as, adhesion, abrasion, erosion, fretting and also can provide non-slip properties for person walking, standing, working on and vehicles traveling on. A hollow wire made of aluminum, or aluminum alloy, or zinc, or zinc alloy, filled with wear resistant particles, such as, oxides or carbides, then thermally metal sprayed onto a substrate of iron alloy, e.g. steel, or aluminum alloy, creates a coating with wear resistant properties that also provides corrosion protection to the substrate. A hollow wire of aluminum or aluminum alloy filled with wear resistant particles then welded to an aluminum alloy, provide a metallurgical compatible coating with wear resistant properties.

4 Claims, 3 Drawing Sheets

ARTICLE PROVIDING CORROSION PROTECTION WITH WEAR RESISTANT PROPERTIES

BACKGROUND

1. Field of Invention

This invention relates to surfacing for wear resistance, specifically to surfacing with a material that also protects the underlying article from corrosion.

2. Description of Prior Art

Aluminum or zinc, when coated onto steel, by the hot dip methods or thermal spray methods, provide a barrier coating that protects steel from corrosion by isolating the steel from the corrosion environment, and also by the cathodic protection principle, whereas, the coating sacrifices itself to protect the steel. Painting is the more familiar method of protecting steel from corrosion through the barrier principle. Hot dip galvanizing is the more familiar method of protecting steel through the use of both the barrier principle and cathodic protection principle. Hot dip aluminizing is another method of protecting steel through the use of both corrosion protection principles. Thermal spraying solid wires or powder is also another familiar method of thermally applying zinc or aluminum onto steel to achieve the two principles of corrosion protection. The barrier principle is simply the process of coating steel with a material that isolates it from the corrosive environment. The cathodic protection principle, performs when the coating has an electromotive potentials more negative than the underlying article, allowing the underlying article to become the cathode and the coating being the anode, when they are exposed to an electrolyte, (corrosive media), the coating will be preferentially attacked thereby protecting the substrate from corrosion. Coatings of zinc or aluminum, or zinc aluminum alloys, being of lower potential than steel, are known to perform this function, and protect steel from corrosion. Other material such as stainless steel or nickel alloys are more positive than steel in the electromotive series, so steel becomes the sacrificial anode when they are coupled. Using the more noble materials as a coating can provide protection to steel by the barrier principle, but will not provide cathodic protection to the steel. Thermally applied Zinc and aluminum coatings, by the before mentioned processes, provide coatings with good corrosion resistance but lack good wear resistance properties.

A solid wire containing a mixture of aluminum and wear resistant particles is manufactured by Alcotech Inc. Traverse City, Mich., for forming a wear resistant coating. This solid wire is limited to a small amount of wear resistant material that can be added, with 10% by volume or less addition, with additions of more than 10% by volume the resultant materials mixture becomes very brittle and cannot be worked, or drawn into a wire or is too brittle to feed with a wire feed process.

A solid wire made of zinc and around 15% by weight of aluminum is manufactured by Platt Brother & Co., Waterbury Conn., for use with the thermal spray processes. The manufacturing of this material is difficult in that aluminum and zinc tend to separate during the manufacturing process, and therefore the coating applied with this material is also inconsistent with patches of pure zinc and pure aluminum, and thus not achieving the full corrosion protection potential of this coating process.

Non slip coatings, are known to be applied, by the electric arc thermal spray process, using filled hollow wires, the use of such wire is shown in U.S. Pat. No. 4,961,973, dated October 1990, W. S. Molnar. This patent does not cite the use of zinc or aluminum for the hollow wire (outer sheath), and did not intend to protect the underlying article from corrosion. The hollow cored wire materials cited in this patent are iron based and will not provide cathodic protection to the substrate, the coating itself will quickly rust and deteriorate when exposed to a corrosive environment. This patent does not consider applications to aluminum substrates, because the iron portion of this filled hollow wire would not provide a suitable metallurgical match for aluminum. The coating would become the anode with the aluminum substrate being the cathode, with this couple, delaminating would soon occur, between the iron base coating and the aluminum substrate.

The thermal methods used to melt and deposit the materials of the present invention are of prior art technology, of the available methods, the most commonly used, are the arc wire thermal spray, flame wire thermal spray, gas metal arc welding, and gas tungsten arc welding. The arc wire thermal spray and flame wire thermal spray methods of applying a coating adheres primarily mechanical to the surface with negligible alloying between the coating and surface of the substrate being coated. The arc wire thermal spray method feeds two wires into respective contact tips that pass electrical current into the wires. The tips are oriented toward each other so the wires extend toward an intersection. A high power is applied across the wires causing an electrical arc to form across the tips of the wires. The electrical current then melts the feed wire portion in the arc zone. A nozzle is located adjacent to the contact tips and oriented to emit an air stream toward the arc zone. The air stream sprays the molten metal onto the work surface forming a coating. The flame wire thermal spray method is similar to arc spray in that it creates a stream of molten metal in a spray form. This method uses one wire and the thermal heat source being of fuel and oxygen. The gas metal arc and gas tungsten arc welding methods melt the surface of the article being coated together with the filler wire to form an alloy of the two materials The gas metal arc welding method uses an electric current as the heat source. A wire goes through a contact tip whereas current is transferred through the wire, and the wire becomes a consumable electrode. The base material is grounded such that an arc is established between the consumable electrode wire and the work surface, as heat is generated by the electric arc, the continuously moving wire and work surface of the base metal melt to form an alloy. The gas tungsten arc welding method is similar in that an electric arc melts the surface of the article being coated. The exception being, the electric arc is established between the base material and a non-consumable electrode held by the welding torch. The work surface of the base material melts and then a filler material is added, in wire or powder form, into the molten puddle. The filler material and base material combine to form an alloy.

OBJECTS AND ADVANTAGES

According to the invention, a hollow wire of aluminum or zinc metal, filled with a material of wear resistance properties, then thermally applied as a coating onto an underlying article, provides corrosion protection of the underlying article and has wear resistance properties.

According to another aspect of this invention, a filled hollow wire of aluminum or zinc metal with said filler comprising, by volume about 10% to around 60% wear resistance particles.

According to another aspect of this invention, a filled hollow wire, of an aluminum alloy with said filler comprising, by volume about 10% to around 60% wear resistance particles can be used to surface aluminum alloys by the welding method, providing a compatible alloy match and a wear resistant coating.

According to another aspect of this invention, a filled hollow wire, of aluminum or aluminum alloy with said filler comprising, by volume about 10% to around 60% wear resistance particles, when applied as a rough coating on an article of steel or aluminum, provides a wear resistance coating that can also be used for a non-slip surface for persons standing, walking, or working on, or vehicles traveling on, and can also provide corrosion protection of the underlying substrate.

According to another aspect of this invention, a filled hollow wire, of zinc or zinc alloy with said filler comprising, by volume about 10% to around 60% wear resistance particles, can be used to provide a coating with non-slip properties for persons walking or working on, or vehicles traveling on, and provide corrosion protection of the underlying article, being of steel or aluminum alloy.

According to another aspect of this invention, a coating deposited on a steel or aluminum article using the thermal spray processes and a filled hollow wire of zinc or zinc alloy with said filler comprising, by volume about 10% to around 60% wear resistance particles will provide corrosion protection of the underlying article and be wear resistant.

According to another aspect of this invention, a coating deposited on concrete using the thermal spray processes and a filled hollow wire of zinc with said filler comprising, by volume about 10% to around 60% wear resistant particles will provide wear protection to the underlying article and can also provide a slip resistant surface.

According to another aspect of this invention, a filled hollow wire of zinc with said filler comprising, by volume about 10% to around 60% mixture of aluminum and wear resistant particles then subsequently thermally sprayed onto an article will deposit a coating uniformly composed of zinc, aluminum, and wear resistant particles.

According to another aspect of this invention, a filled hollow wire of aluminum with said filler comprising, by volume about 10% to around 60% mixture of zinc and wear resistant particles then subsequently thermally sprayed onto an article will deposit a coating uniformly composed of aluminum, zinc and wear resistant particles.

Further objects and advantages are to provide coatings that will provide a wear resistant surface that resists adhesive wear, abrasive wear, erosive wear, and fretting wear and withstand impact, and provide corrosion protection of the underlying article by the barrier and cathodic protection principle. Further objects and advantages will become apparent from a consideration of the ensuing description and drawings.

DRAWING FIGURES

REFERENCE NUMERALS IN DRAWINGS

Figure 1:
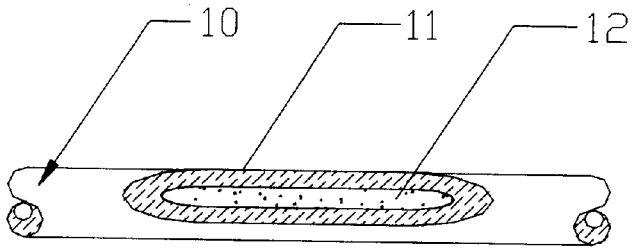
FIG. 1 is a pictorial view of the hollow cored wire with a cut a way section revealing inner core substance.

10 filled hollow wire
11 outer sheath
12 filler material
20 mechanical lock
30 arc spray apparatus
31 air nozzle
32 contact tip
32A contact tip
33 electrical energy source
35 molten droplets
36 receiving surface
37 substrate
38 feed roll
38A feed roll
39 coating
51 slip resistant surface
40 welding apparatus
41 weld
42 base metal
43 fusion zone
44 weld surface
45 gas metal arc welding gun Summary In accordance with the present invention a hollow wire filled with a material and subsequently applied as a coating onto an article provides a wear resistant surface and corrosion protection of the said article.

Figure 2:
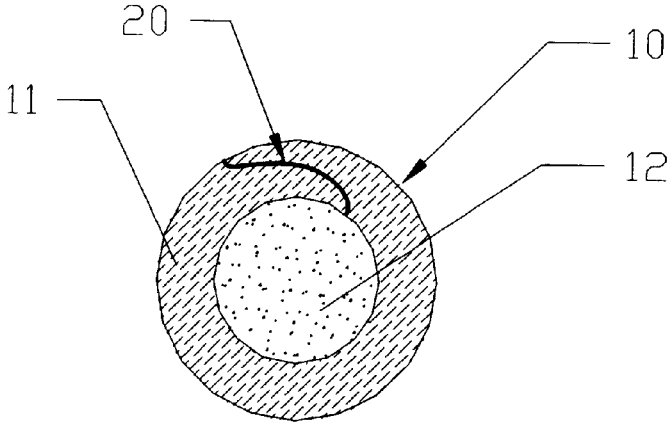
FIG. 2 is a sectional view to enlarged scale of the article of FIG. 1
Figure 3:
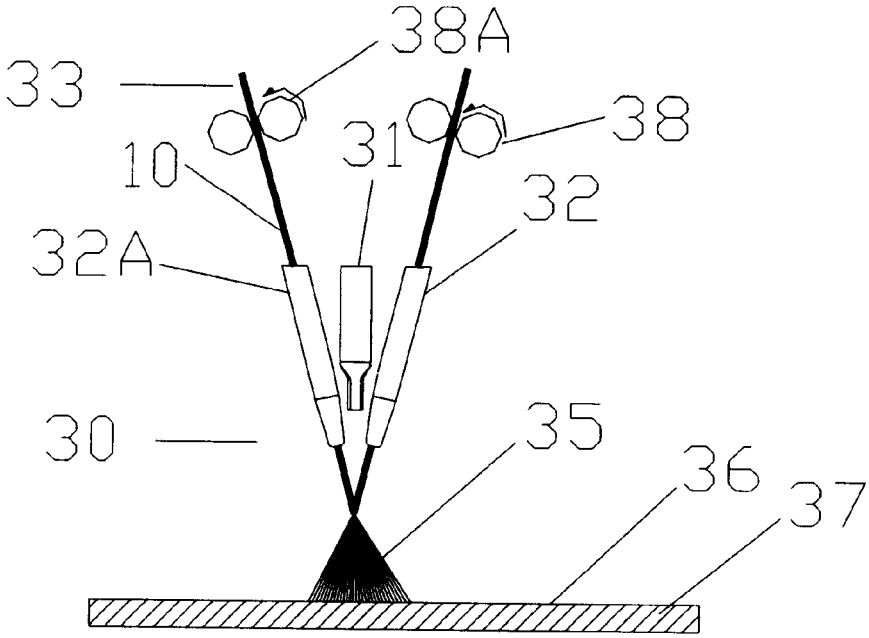
FIG. 3 is a pictorial view of a thermal arc spray apparatus.
Figure 4:
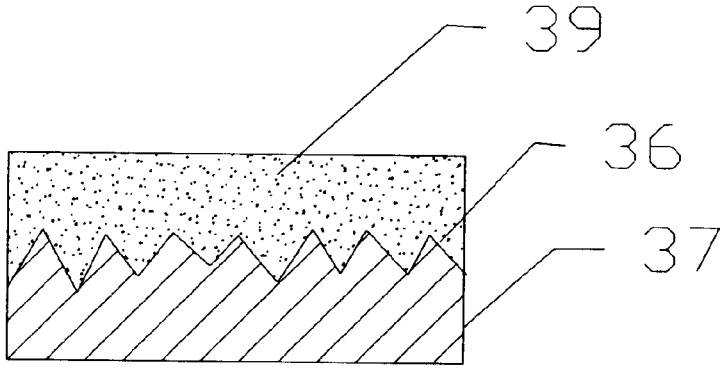
FIG. 4 is a sectional view to enlarged scale of a thermal sprayed coating showing the receiving surface profile and coating matrix.
Figure 5:
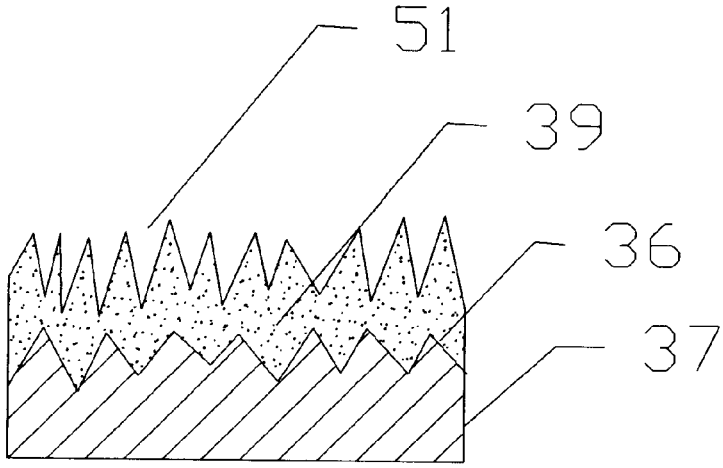
FIG. 5 is a sectional view to enlarged scale of a slip resistance surface applied with thermal arc spray apparatus shown in FIG. 3.

Looking now at the drawings, FIG. 1 shows a filled hollow wire 10 with a cut away view exposing the outer sheath 11 and filler material 12, manufacturing filled hollow wires is a routine prior art (not shown), the wire starts as a flat thin strip of metal and is formed into a round wire, during forming of outer sheath 11, filler material 12 is added and becomes the inner core, FIG. 2 is an enlarged cross sectional view of filled hollow wire 10 and shows a mechanical lock 20 which holds the formed strip together maintaining the wire form and containing the filler material. The present invention uses aluminum or aluminum alloys, or zinc, or zinc alloys as material for the outer sheath 11, the filler material 12 is generally a material with high wear capabilities such as carbides or oxides. Also, with the capabilities of being able to add from about 10% to around 60% by volume of a wear resistance material with aluminum powder, as filler material 12, and subsequent thermal sprayed, results in a coating uniformly composed of zinc, aluminum with wear resistant particles. The thermal arc spray coating method is the more common technique to form coating 39, FIG. 3 shows a typical thermal arc spraying apparatus 30, comprises a nozzle 31, contact tubes 32 and 32A, means to feed wires 38, and 38A, and electrical energy source 33, used in combination with filled hollow wire 10. Filled hollow wire 10 is converted to molten droplets 35 by an electric arc and then atomized and impelled by air pressure against the receiving surface 36 of substrate 37. The results being an inherent coating as shown in FIG. 4 coating 39. Looking at FIG. 4, substrate 37 has a receiving surface 36 with a rough profile. This profile is required for coating 39 to adhere to substrate 37. Receiving surface 36 is roughen and cleaned via a grit blasting apparatus (not shown), or other surface preparation methods that provide a clean and rough profile. FIG. 4 also shows a gritty or sandy looking matrix contained in coating 39. The filler material 12, of hollow wire 10 is added to achieve a wear resistant coating and is distributed randomly as coating 39 is being formed. Filler material 12 is selected, so not to completely alloy, with outer sheath 11, the resultant matrix of coating 39 containing some pure particle of filler materials 12, and pure material of outer sheath 11, this maintains the corrosion protection properties of the coating when receiving substrate 37 is of steel alloy, or to provide compatibility if receiving substrate 37 is of an aluminum alloy. FIG. 5 shows a variation in surface profile of coating 39, this rough profile is formed by variations in parameters of arc spraying apparatus 30, the rough profile provide a non-slip surface for persons walking, standing, or working on, and for vehicle traffic.

Figure 6:
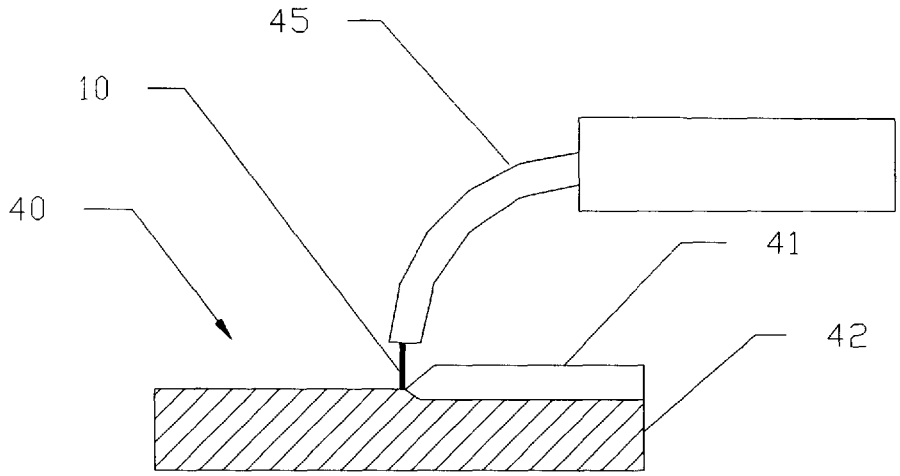
FIG. 6 is a pictorial view of the gas metal arc welding apparatus.
Figure 7:
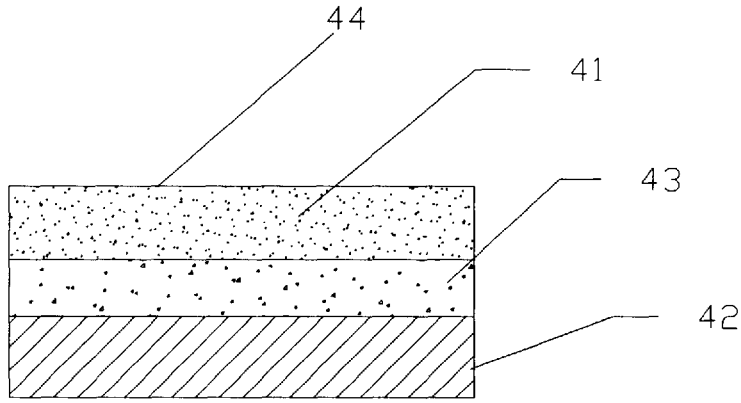
FIG. 7 is a sectional view to enlarged scale of a welded coating showing fusion zone and weld material matrix.

Looking now at FIG. 6 Welding apparatus 40 is a surfacing method that melts the filled hollow wire 10 and the base metal 42 to form a coating that is alloyed to the underlying article, In this coating method outer sheath 11 (FIG. 1) is an aluminum alloy, and the filler material 12 is primarily non alloying with outer sheath 11, or alloys with metallurgical compatibly with outer sheath 11 and the base metal 42 which also is an aluminum alloy. Welding apparatus 40 performs by continuously feeding filled hollow wire 10 through a gas metal arc welding gun 45, inert gas coming from the gun (not shown) surrounds the molten puddle and shields it from the atmosphere. An electric arc is established between base metal 42 and filled hollow wire 10, this electric arc melts the surface of base metal 42 and the filled hollow wire 10. As melting occurs the filled hollow wire is continuously fed into the molten puddle and the gas metal arc weld gun 45 is moved along the surface leaving a weld 41 behind. FIG. 7 shows an enlarged section of the deposited weld 41. This deposited weld 41 is a mixture, or alloy, of base metal 42 and filled hollow wire 10, during the welding process both materials are melted and mixed together in the same molten pool. The base metal 42, and filled hollow wire 10, mix in different amounts from the fusion zone 43 to weld surface 44, with the higher amount of filled hollow wire 10 being at surface 44, therefore, placing the wear resistance materials, of the filled hollow wire 10, closer to the surface for wear resistance benefits. Also, as more weld layers are applied a higher percentage of the filled hollow wire 10 is at the surface.

Conclusions, Ramifications, and Scope

Accordingly, the reader will see the present invention to be the process of providing a coating using a filled hollow wire with the outer sheath material being of aluminum or zinc material filled with a wear resistant material or in combination with aluminum or zinc powder, or other combination of materials. The coatings have wear resistant properties and can also provides cathodic protection to a coated object, and provides a wear resistant coating material that can be applied to an aluminum alloy and be metallurgical compatible. Furthermore, the coating process has the additional advantages in that;

It provides a thermal sprayed coating that has wear resistance properties and protects materials, such as those composed of iron, e.g. steel, from corrosion by the barrier and cathodic protection principle.

It provides a method to add substantial amounts of wear resistant particle to aluminum or zinc, and allows the making of a wire that is not brittle and can be used in a wire feed system to form a coating.

It provides a method to combine aluminum and zinc with other materials to obtain coatings with a multitude of properties including being wear resistant.

It provides a method to combine aluminum or zinc with other materials to obtain properties that can produce coatings with high bond to the coated article.

It provides a process to obtain a wear resistant coating on aluminum alloys and is metallurgical compatible.

It provides a method of coating materials composed of iron, such as, steel, with a coating that has substantially non-slip properties that also provides corrosion protection to the coated article.

It provides a method of coating aluminum with a coating that has non-slip properties and is metallurgical compatible.

Although the description above contains specificities, these should not be construed as limiting the scope of the invention but as merely providing illustrations of some of the presently preferred embodiments of this invention. For example, the hollow wire material may be any alloy that provides cathodic protection to the coated article, and the fill material may be any material that contributes to the coating, to the corrosion protection of the coated article, to improving the wire manufacturing process, or improves the application method.

Thus the scope of the invention should be determined by the appended claims and their legal equivalents, rather than by the examples given.

I claim:

1. A process for forming a deposit on a receiving surface of an article comprising the steps of;

providing a hollow wire, said hollow wire being about 0.030 inch diameter to around 0.187 inch diameter, said hollow wire being composed of aluminum or composed of zinc, said hollow wire filled with particles of oxides and/or carbides, said particles having hardness about Rc20 to around Rc90 said deposit being formed by thermal spray, whereby, the said deposit provides a surface that is substantially wear resistant.

2. The process of claim 1 whereas said receiving article is composed of concrete.

3. The process of claim 1, whereby said deposit is slip resistant.

4. A process for forming a deposit on a receiving surface of an article comprising the steps of;

providing a hollow wire, said hollow wire being about 0.030 inch diameter to around 0.187 inch diameter, said hollow wire being composed of aluminum, said hollow wire filled with particles of oxides and/or carbides, said particles having hardness about Rc20 to around Rc90 said deposit being formed by welding, said receiving article being composed of aluminum, whereby, the said deposit provides a surface that is substantially wear resistant.

* * * * *